United States Patent [19]

Staudinger

[11] 4,022,591

[45] May 10, 1977

[54] COAL GASIFICATION APPARATUS

[75] Inventor: Gernot Staudinger, Amsterdam, Netherlands

[73] Assignee: Shell Internationale Research Maatschappij B.V., Netherlands

[22] Filed: June 14, 1976

[21] Appl. No.: 695,600

Related U.S. Application Data

[63] Continuation of Ser. No. 602,325, Aug. 6, 1975, abandoned.

[30] Foreign Application Priority Data

Aug. 28, 1974 Netherlands ..... 7411433

[52] U.S. Cl. ..... 48/76; 48/63; 48/69; 48/86 R; 110/28 R; 110/28 J; 110/28 Q

[51] Int. Cl.[2] ..... C10J 3/50; C10J 3/52; F23D 19/00

[58] Field of Search ..... 48/76, 77, 63, 64, 62 R, 48/69, 86 R, 101, 203, 206, 210, 78; 110/28 R, 28 J, 28 P, 28 Q, 28 W

[56] References Cited

UNITED STATES PATENTS

| | | | |
|---|---|---|---|
| 875,813 | 1/1908 | Heinz | 48/69 X |
| 1,022,388 | 4/1912 | Duff | 48/69 X |
| 1,953,312 | 4/1934 | Plummer | 48/63 |
| 2,699,384 | 1/1955 | Peery et al. | 48/206 |
| 2,716,598 | 8/1955 | Moses | 48/63 X |
| 2,801,158 | 7/1957 | Grossman et al. | 48/78 |
| 3,000,711 | 9/1961 | Eastman et al. | 48/63 |

*Primary Examiner*—Joseph Scovronek
*Attorney, Agent, or Firm*—Pravel, Wilson & Gambrell

[57] ABSTRACT

An apparatus for the continuous gasification of coal by partial combustion with a reactant gas is disclosed, wherein a vertical gasification reactor is provided with a reactant supply and ash removal assembly adapted to supply coal and reactant gases and to remove ash particles to and from the reactor via a constricted passageway in the reactor bottom. The assembly includes an ash quench chamber having means for supplying coal and reactant gases through the reactor disposed therein which opens opposite the constricted passageway a predetermined distance therefrom. The apparatus may be operated continuously without collecting by-product ash particles in the reactor and without superheating the reactant supply means.

8 Claims, 2 Drawing Figures

FIG. 1.
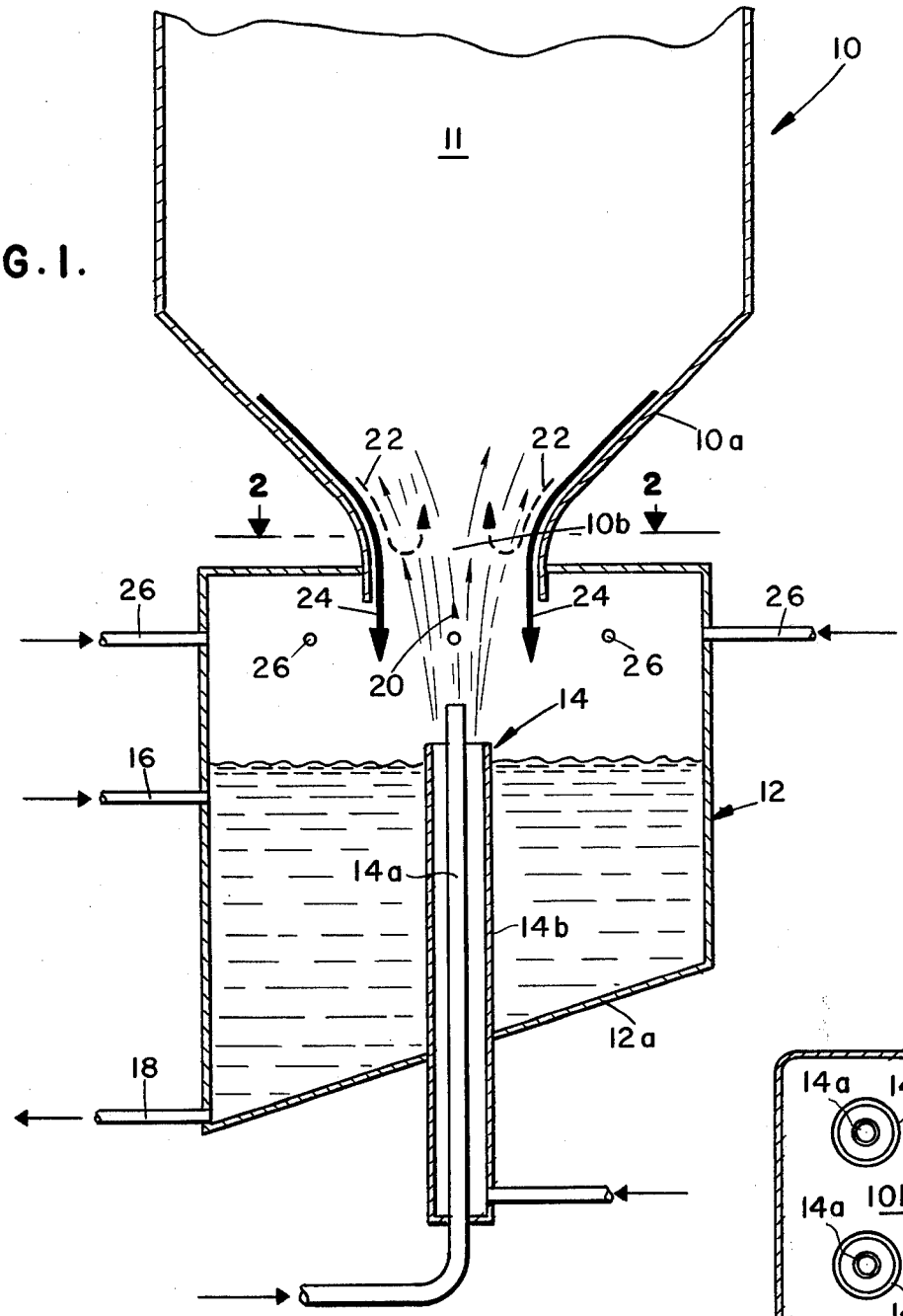
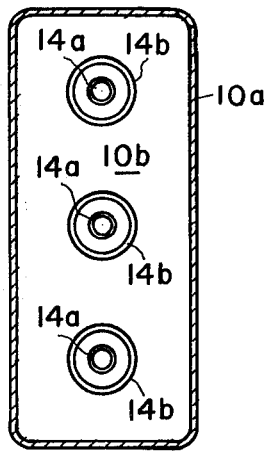
FIG. 2.

COAL GASIFICATION APPARATUS

This is a continuation of application Ser. No. 602,325, filed Aug. 6, 1975, now abandoned.

BACKGROUND OF THE INVENTION

This invention relates to the gasification of coal and more particularly pertains to an apparatus for the partial combustion of coal with oxygen or gas containing oxygen which allows continuous gasification without the ash content of the coal presenting any problems.

Over the years, a number of processes and apparatus have been developed for coal gasification to take into account many variable factors including, by way of example, the source of coal employed, the gasifying medium employed, the ultimate use to be made of the product gas and the like. In this context, coal is taken to comprise a great variety of free-carbon-containing fuels, such as anthracite, bituminous coal, brown coal, lignite, soot, coke, etc. Additionally, many of these known processes and apparatus have been devised and employed to produce a product gas comprised primarily of carbon monoxide and hydrogen. Such product gases are extremely useful as a fuel, whether further treated or not, and are important base materials for chemical syntheses such as the preparation of ammonia and hydrocarbons.

While known coal gasification processes and apparatus may differ in a variety of ways, all are presented with the common problem of removing the non-carbonaceous, mineral residue produced during gasification from the reactor apparatus. Without the employment of special precautions the residue, or ash content, may accumulate in undesirable places in the gasifier apparatus thereby adversely affecting the gasification. These problems vary with the type of residue formed, e.g. dry ash or molten slag, and are particularly prevalent with molten slag.

An additional problem associated with conventional gasification techniques and apparatus resides in supplying the coal and gasifying medium to the gasification reaction zone. Inasmuch as gasification is usually carried out at extremely high temperatures, i.e., usually above about 1400° C. to about 2700° C., any supplying means, such as reactor inlet tubes or the like, subjected to such temperatures may become superheated which may result in mechanical problems or otherwise adversely affect the continuous supply of the coal and gasification medium to the reactor.

SUMMARY OF THE INVENTION

Accordingly, the present invention provides an apparatus which allows continuous gasification without the aforementioned problems associated with the ash content of the coal and the supplying of coal and gasifying medium to the reactor. The novel apparatus of the invention includes a vertical reactor provided with a means for supplying reactants and removing ash particles via a constricted passageway formed in the reactor bottom. This means includes an ash quench chamber disposed about the reactor constricted passageway having means for supplying coal and reactant gases through the reactor disposed therein a predetermined distance from the constricted passageway. The positioning of the reactant supply means in the chamber prevents its exposure to high reaction temperatures which may result in the aforementioned superheating problems while ash particles are simultaneously removed from the reactor via the passageway and quenched in the chamber.

BRIEF DESCRIPTION OF THE DRAWINGS

FIG. 1 is a schematic side view, partially cut away and in cross-section, of the apparatus of the invention illustrating in detail the ash quench and reactant supply assembly; and FIG. 2 is a cross-sectional view taken along line 2—2 of FIG. 1 illustrating the preferred embodiment of the invention wherein the vertical reactor constricted passageway has an elongated horizontal cross-section form and a plurality of sets of coaxial tubes arranged side by side are employed to supply reactants to the reactor.

DETAILED DESCRIPTION OF THE PREFERRED EMBODIMENTS

Referring now to FIG. 1, the apparatus of the invention includes a vertical reactor, generally designated as 10, which forms a reaction zone 11 wherein coal may be partially combusted with a reaction gas such as oxygen, a gas containing oxygen, and, if desired, steam to produce a product gas comprising primarily hydrogen and carbon monoxide. The vertical reactor has a downwardly sloping bottom wall 10*a* which is provided with a constricted passageway or throat 10*b* at its lowermost portion through which coal and reactant gases and by-product ash are continuously supplied to and removed from the reactor during operation. As more particularly described hereafter, the constricted passageway 10*b* has a predetermined size, which is smaller than the vertical reactor 10 diameter. The reactor 10 is also provided with a product gas outlet means (not shown) of conventional construction for removal of product gas formed in the reaction zone 11.

The inventive apparatus further includes an ash quench chamber, generally 12, mounted with the reactor downwardly sloping bottom wall 10*a* about the constricted passageway 10*b* which has a set of coaxial reactant supply tubes 14 disposed therein. The set of reactant supply tubes 14 protrude through the quench chamber bottom wall 12*a* and open a predetermined distance opposite the reactor constricted passageway 10*b* and, preferably, include an inner tube 14*a* for supplying powdered coal and an outer tube 14*b* for supplying oxygen or a gas containing oxygen along with steam, if desirable.

The ash quench chamber 12 is provided with a suitable inlet 16 for supplying and maintaining an amount of water therein. The supply of water maintained in the ash quench chamber 12 quenches the ash particles and cools the set of coaxial supply tubes 14 protruding therethrough.

The ash quench chamber also has an inclined surface below the water line, preferably the chamber bottom wall 12*a*, and a suitable outlet 18, such as a pressure lock, located near the lowest point for removal of solidified slag. The positioning of the slag outlet 18 adjacent the lowest point of the inclined surface or bottom wall 12*a* leads to more efficient slag removal.

In the operation of the apparatus of the invention, coal, preferably powdered coal, and reactant gases, which may be oxygen or a gas containing oxygen and, if desirable, steam, are injected under pressure through the set of coaxial tubes 14 and fed to the reactor 10 through the constricted passageway 10*b*, preferably through the center of one axis of the constricted passageway 10*b*, in the form of a jet, as indicated by the arrows 20 in FIG. 1. The coal-reactant gas mixture ignites immediately after it has entered the reactor 10. The combustion reaction is thus situated completely in the reaction or flame zone 11 of the reactor 10.

During reaction, hot gas is recirculated in the reactor, which leads to flame stabilization. The temperature prevailing throughout the reactor 10 is so high that resulting by-product ash is liquid and descends along the walls of the reactor in the form of liquid slag towards the constricted passageway 10*b*. It is important that the reactor bottom wall 10*a* be maintained at a very high temperature to prevent accumulation of slag at the passageway 10*b*. Such a high temperature is maintained in the inventive apparatus by the recirculating gas in the reaction zone that tends to descend through the constricted passageway 10*b*. This gas is entrained in the opposite direction by the injected jet of reactants supplied by the set of coaxial tubes 14. The descending and entraining of the recirculating gas adjacent the constricted passageway 10 is shown in FIG. 1 by the arrows 22. Moreover, thermal radiation emanating from the ignition of the reactant mixture supplies heat to the reactor bottom wall 10*a* and constricted passageway 10*b*.

By maintaining very high temperatures at the reactor bottom wall 10*a* and constricted passageway 10*b*, the by-product ash is maintained in the form of liquid slag which readily falls through the constricted passageway 10*b*, as shown by arrows 24, into the water supplied and maintained in the ash quench chamber 12. Accumulation of the by-product ash in the reactor, particularly at the critical point of the constricted passageway 10*b* is, therefore, eliminated. The liquid slag solidified in the ash quench chamber 12 may then be readily removed via the slag outlet 18, described hereinbefore.

During quenching of the liquid slag, the heat that is released converts the water maintained in the ash quench chamber 12 into steam, which is entrained with the jet of coal and reactant gases from the set of coaxial tubes 14 and forced into the reactor 10. The pressure in the chamber 12 is equal to that in the reactor 10, so that the steam formed can be used immediately.

The apparatus of the invention may be operated under any desired pressure. Moreover, the gasification may be carried out with or without steam addition, which can be supplied through the set of supply tubes 14 along with steam produced during slag quenching, mentioned hereinbefore.

In the apparatus of the invention, the set of coaxial tubes 14 are positioned in the chamber 12 for opening the reactor constricted passageway 10*b* below and above the water maintained in the chamber 12. Preferably, the diameter of the constricted passageway is about 3 to about 10 times the diameter of the outer tube 14*b* for the purpose of facilitating the discharge of the liquid slag without adversely affecting injection of the mixture of coal and reactant gases, such as by accumulation of the slag on the set of reactor tubes 14. Additionally, the positioning of the set of supply tubes 14 in the quench chamber 12, as described, is an elegant solution to the frequently arising problem of superheating of the metal supply tubes as a result of flame radiation. The tubes 14*a*, 14*b* are considerably cooled by the surrounding water maintained in the quench chamber 12.

Further, the ash quench chamber 12 is preferably provided with a plurality of inlets 26 spaced at regular intervals adjacent the constricted passageway 10*b* for supplying oxygen thereto. The supply of oxygen via these inlets, which may be as much as 5% of the total quantity of oxygen required for the partial combustion in the reactor, ignites the small proportion of the above-mentioned recirculating gas which descends through the constricted passageway 10*b* (as shown by the arrows 22) which contributes to maintaining the reactor bottom wall and constricted passageway 10*a*, 10*b* at the desired high temperature.

The apparatus of the invention may include any desired number of sets of coaxial supply tubes. As illustrated in FIG. 2, with a view to enlarging capacity it is possible to provide a plurality of sets of supply tubes 14 which may be arranged side by side opposite the constricted passageway 10*b* which may be provided with an elongated horizontal cross-section shape. If desirable, the horizontal cross-sections of the reactor 10 and the ash quench chamber 14 may also have an elongated form. Preferably, when a plurality of supply tube sets 14 are employed, they are positioned substantially centrally in line in respect to the diameter of the width of the constricted passageway 10*b*.

The foregoing disclosure and description of the invention are illustrative and explanatory thereof, and various changes in the size, shape and material as well as in the details of the illustrated construction may be made without departing from the spirit of the invention.

I claim as my invention:

1. An apparatus for the gasification of coal comprising:

a vertical reactor forming a reaction zone for partial combustion of powdered coal with a gas containing oxygen for producing a product gas and provided with a bottom having a constricted passageway;

outlet means for removing product gas from the vertical reactor; and means for supplying coal and reactant gases to said reactor and for removing ash particles from said reactor via said constricted passageway, said means including:

a chamber connected with the reactor bottom and disposed about the constricted passageway;

means for supplying coal and reactant gases through the reactor disposed in the chamber and opening opposite the constricted passageway;

inlet means for supplying and maintaining water in the chamber for quenching ash particles passing from the vertical reactor through the constricted passageway and for cooling the means for supplying said coal and reactant gases; and outlet means for removing solidified slag particles from the chamber.

2. The apparatus of claim 1 wherein the means for supplying coal and reactant gases to the vertical reactor includes:

a set of coaxial tubes protruding into the chamber, said set of coaxial tubes being positioned in a substantially central position with and opening opposite the constricted passageway above the water maintained in the chamber.

3. The apparatus of claim 2 wherein the size of the constricted passageway is from about 3 to about 10 times the diameter of the outermost tube of the set of coaxial tubes.

4. The apparatus of claim 2 wherein a plurality of sets of coaxial tubes are provided.

5. The apparatus of claim 4 wherein the constricted passageway has an elongated horizontal cross-section form.

6. The apparatus of claim 1 including inlet means for supplying a gas containing oxygen to the chamber, said means being positioned adjacent the constricted passageway for igniting recirculating product gas descending from the reactor through the constricted passageway.

7. The apparatus of claim 1 wherein the chamber is provided with an inclined surface below the surface of water maintained therein; and said outlet means for removing solid slag particles is located adjacent the lowermost portion of the inclined surface.

8. The apparatus of claim 1 wherein the vertical reactor bottom slopes downwardly, the constricted passageway being provided at the lowermost portion thereof.

* * * * *